US008635846B2

(12) United States Patent
Hendrix et al.

(10) Patent No.: US 8,635,846 B2
(45) **Date of Patent: *Jan. 28, 2014**

(54) FIRE RETARDANT FABRICS AND METHODS FOR MAKING THE SAME

(75) Inventors: James E. Hendrix, Pacolet, SC (US); Tung-Yuan Ke, Shen Kang Hsiang (TW); Fabrizio Balestri, Cardif by the Sea, CA (US); Mark Zwerenz, La Jolla, CA (US)

(73) Assignee: Lorica International Corporation

( * ) Notice: Subject to any disclaimer, the term of this patent is extended or adjusted under 35 U.S.C. 154(b) by 132 days.

This patent is subject to a terminal disclaimer.

(21) Appl. No.: 13/074,794

(22) Filed: Mar. 29, 2011

(65) Prior Publication Data

US 2011/0239618 A1 Oct. 6, 2011

Related U.S. Application Data

(63) Continuation-in-part of application No. 11/600,681, filed on Nov. 15, 2006, now Pat. No. 7,937,924.

(60) Provisional application No. 61/318,490, filed on Mar. 29, 2010.

(51) Int. Cl.
*D01G 1/08* (2006.01)

(52) U.S. Cl.
USPC ..... 57/2

(58) Field of Classification Search
USPC ..... 57/2; 19/0.35, 0.39
See application file for complete search history.

(56) References Cited

U.S. PATENT DOCUMENTS

| | | | | | |
|---|---|---|---|---|---|
| 3,945,188 | A * | 3/1976 | Muller | 57/2 |
| 4,118,921 | A * | 10/1978 | Adams et al. | 57/200 |
| 4,457,345 | A * | 7/1984 | von Blucher et al. | 139/420 R |
| 4,547,933 | A * | 10/1985 | Lauterbach | 19/0.35 |
| 4,924,556 | A * | 5/1990 | Gilhaus | 19/0.35 |
| 7,100,246 | B1 * | 9/2006 | Perrotto et al. | 19/0.35 |
| 7,937,924 | B2 * | 5/2011 | Ke | 57/2 |
| 2007/0148455 | A1 * | 6/2007 | Ke | 428/375 |
| 2008/0113175 | A1 * | 5/2008 | Ke | 428/221 |

* cited by examiner

*Primary Examiner* — Shaun R Hurley
(74) *Attorney, Agent, or Firm* — Jerry R. Potts

(57) ABSTRACT

A fire retardant fabric is manufactured from oxidized polyacrylonitrile fibers having a fineness of about 0.5 to about 1.5 denier per fiber.

18 Claims, 2 Drawing Sheets

FIRE RETARDANT FABRICS AND METHODS FOR MAKING THE SAME

CROSS REFERENCE TO RELATED APPLICATIONS

This application is a continuation in part of and claims priority to copending U.S. patent application Ser. No. 11/600,681, filed Nov. 15, 2006, which claims priority to U.S. Provisional Patent Application Ser. No. 60/921,476, filed Nov. 16, 2005, the contents of which are herein incorporated by reference in their entirety. This application also claims priority to U.S. Provisional Patent Application Ser. No. 61/318,490, filed Mar. 29, 2010, the contents of which is herein incorporated by reference in its entirety.

TECHNICAL FIELD

The present disclosure relates generally to fire retardant fabrics and more specifically to fire retardant fabrics made from oxidized polyacrylonitrile fibers having a fineness of about 0.5 to about 1.5 denier per fiber.

BACKGROUND OF THE INVENTION

Fire retardant materials are resistant to burning and combustion. Some fire retardant materials can be used to make fire retardant fabrics for use in making clothing. Such clothing can be used by welders, race car drivers, military personnel, fire fighters and others which may be exposed to fires and incendiary conditions.

Some fire retardant fabrics can be made from cellulosic fibers which can be treated with chemicals to acquire appropriate fire retardant properties. Organic phosphorus compounds can be used for such chemical treatment. However, chemical treatment typically reduces the physical and aesthetic properties of the fabric and can increase the weight of the fabric by about 35 percent. In addition, such chemical treatment can reduce the tensile strength, tear strength, burst strength and abrasion resistance of the fabric. Furthermore, laundering of some fire retardant fabrics can result in a deterioration of physical properties and aesthetics thereof. Moreover, chemically treated fire retardant fabrics can be rough and stiff and therefore uncomfortable to wear.

SUMMARY

According to aspects illustrated herein, there is provided a fire retardant fabric manufactured from oxidized polyacrylonitrile fibers (OPF) having a fineness of about 0.5 to about 1.5 denier per fiber.

The present invention also includes a method for making a fire retardant fabric. The method includes use of an apparatus and process for making a fire retardant yarn, disclosed in commonly owned and copending U.S. patent application Ser. No. 11/600,681, filed Nov. 15, 2006. Use of the apparatus and process with the OPF having the fineness of about 0.5 to about 1.5 denier per fiber has utility and generates the unexpected result of enabling use of such OPF to form the fire retardant yarn therefrom. Prior to the discovery of the present invention, use of OPF having a fineness of about 0.5 to about 1.5 denier per fiber was considered by those skilled in the relevant art to be too fine and therefore too difficult and expensive to handle and process.

The method includes providing one or more tows of OPF having a fineness of about 0.5 to about 1.5 denier per fiber. The method employs an apparatus for converting a tow of the OPF into the yarn in a continuous operation. The apparatus includes a feed section having one or more spools removably mounted thereon. The feed section is operably coupled to a drafting section comprising a first roller pair and a second roller pair. The drafting section is operably coupled to a spinning section which includes one or more bobbins removably mounted thereon.

One or more of the tows of the OPF is positioned on one or more of the spools, with the fibers being longitudinally aligned with one another in a generally flat and untwisted form. The tows are pulled from the spools by unwinding and applying tension, thereby maintaining the tows in the generally flat and untwisted form. The generally flat and untwisted tows are then fed to the drafting component.

In the drafting component, each of the rollers of the first roller pair have substantially conterminous opposed surfaces and spin at a first speed. The second roller pair is positioned downstream of the first roller pair and each of the rollers of the second roller pair have substantially conterminous opposed surfaces and spin at a second speed. The second speed is greater than the first speed. The fibers in the tows are stretched and broken between the first and second roller pairs while urging each of the rollers of the respective first and second roller pairs towards one another. The stretched and broken fibers are formed into a cohesive elongated network of fibers in the drafting component.

The cohesive elongated network of fibers is discharged from the drafting component to the spinning component where they are spun and twisted onto the bobbins thereby forming the yarn. The spinning and twisting causes the yarn to have a twist count of about 100 twists per meter to about 800 twists per meter.

Providing the fine denier OPF tow on the spools, pulling the tow from the spools, applying tension to the first and second roller pairs, stretching and breaking the fine denier OPF to form the cohesive elongated network of the fine denier OPF and the spinning and twisting thereof, all take place in a single pass through the apparatus. The yarn made from the fine denier OPF is subsequently formed into the fire retardant fabric by a knitting, a weaving, a braiding and/or a stitch-bonding process. The fine denier OPF tow can be chopped into staple fiber and subsequently formed into the fire retardant fabric by a needle punching, an air-laid, a felting, a water jet entanglement and/or an air jet entanglement process.

According to other aspects illustrated herein, the OPF are provided in one or more tows having between about 3,000 fibers to about 24,000 fibers, per tow. The OPF are stretched and broken into pieces. For example, substantially all of the OPF are stretched and broken such that their length is within a range of about 2.5 cm to 23 cm. The stretched and broken OPF are formed into a yarn, such as a yarn having a twist count of about 100 twists per meter to about 800 twists per meter.

In addition to the OPF, fibers made from other materials can be used to form the tow, yarn and/or fire retardant fabric. For example, Spandex fibers, stretchable fibers, stainless steel wire filaments, aramid fibers and/or polysulfonamide fibers are used in addition to the OPF. In some instances, the fibers made from the other materials are processed substantially simultaneously with the OPF, the tows, the yarn and/or the fire retardant fabric.

According to other aspects illustrated herein, the fire retardant fabric has: 1) a vertical flammability char length of about zero to about 2.0 inch; 2) an afterflame time of about zero to about 0.5 seconds; 3) limiting oxygen index of about 40% to about 60%; and/or 4) a thermal protective performance value of about 12 to about 24 for a single layer of the fire retardant fabric.

BRIEF DESCRIPTION OF THE DRAWING

Referring now to the Figures, which illustrate exemplary embodiments, and wherein like elements are numbered alike.

DETAILED DESCRIPTION OF PREFERRED EMBODIMENTS

The present invention is directed to fire retardant fabrics for use in protecting people and objects from heat, hot objects, sparks and fire, and in general provide thermal insulation. The fire retardant fabrics finds utility in many consumer products such as but not limited to blankets, jacket linings, boot linings, helmet linings, jerseys, shirts, pants, balaclavas, gloves, shields and the like. In one embodiment, the fire retardant fabric is manufactured from one or more tows of 100% oxidized polyacrylonitrile fibers (OPF). Each individual fiber of the OPF has a fineness within a range of about 0.5 denier per fiber to about 1.5 denier per fiber (the range hereinafter defines the term "fine denier OPF"). The fineness is expressed in denier per fiber which is a unit of measure for the linear mass density of fibers, namely the mass in grams per 9,000 meters of the fiber.

In addition to being fire retardant, fine denier OPF has utility in that yarn and fabric formed therefrom is generally abrasion resistant, pliable, soft to touch and comfortable to feel on a person's skin, compared to OPF having deniers greater than 1.5. These desirable qualities are due in part to a greater flexibility of the fine denier OPF compared to those having deniers greater than 1.5. In addition, the fine denier OPF are less brittle than OPF having a denier greater than 1.5. Thus, when the fine denier OPF are processed (e, g., bent, cut or broken) during manufacturing fewer stray pieces (e.g., fiber-fly) are generated, than for similar processing of OPF having deniers greater than 1.5. Reduction in the amount of fiber-fly results in both a cleaner fabric and a cleaner manufacturing facility.

Each of the above described tows of OPF is composed of about 6,000 fibers to about 12,000 fibers. However, tows of OPF having about 3,000 to about 24,000 fibers and/or tows having about 5,000 to about 7,000 fibers or combinations thereof can also be employed without departing from the broader aspects of the present invention. In one embodiment, the tows of the fine denier OPF are provided on spools with each fine denier OPF being longitudinally aligned with one another in a generally flat and untwisted form, for example having a twist number of less than about 50 twists per meter. In addition, after stretching and breaking the fine denier OPF, as described below, substantially all of the fine denier OPF have lengths within a range of about 2.5 cm to 23 cm. While tows of OPF having number of fibers in the ranges of: 1) about 6,000 to about 12,000; 2) about 3,000 to about 24,000; and 3) about 5,000 to about 7,000, are described, the present invention is not limited in this regard as tows having any number of fibers greater than and/or less than can also be employed either alone in combination with one another or the above described ranges.

Figure 1:
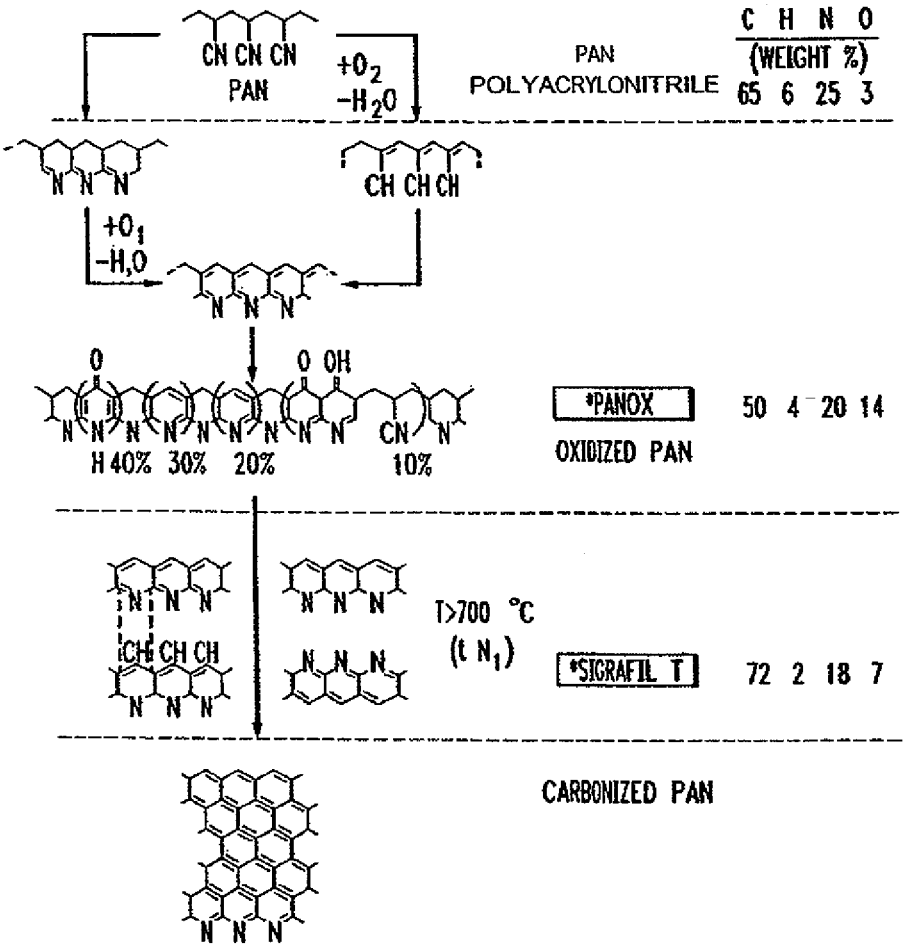
FIG. 1 illustrates the chemical structures of polyacrylonitrile (PAN), oxidized PAN and carbonized PAN.

The chemical composition of polyacrylonitrile (PAN) and oxidized PAN is illustrated in FIG. 1. In one embodiment, the PAN is produced using an oxidative pyrolytic processes. For example, oxidative stabilization may be performed at atmospheric pressure in the presence of oxygen at a temperature of about 200-300 degrees Celsius. At about 300 degrees Celsius the PAN turns black in color which is indicative of the transformation to oxidized PAN. In one aspect, the oxidized PAN used in the practice of the present invention has a density of about 1.30 to about 1.50 g/cm$^3$, a carbon content of about 55 to about 68%, and a Limiting Oxygen Index (LOI) value of about 40% to about 60%. The LOI is a measure of the percentage of oxygen that has to be present to support combustion of a material. Flammability of the OPF decreases with increasing LOI. The oxidized PAN has a planar polymer structure which provides for an increased thermal stability and resistance to further oxidation, compared to PAN having linear structures.

While the fire retardant fabric is described above as being manufactured from 100% OPF, the present invention is not limited in this regard as other materials in addition to the fine denier OPF can be employed to form a hybrid tow, hybrid yarn and/or hybrid fabric including but not limited to one or more of the following examples.

In one embodiment, stretchable fibers, for example Spandex fibers are employed in addition to the fine denier OPF. The stretchable fibers are introduced with the fine denier OPF into the tow (e.g., during tow preparation), formed into another tow, introduced into the yarn (e.g., during yarn formation) and/or introduced into the fire retardant fabric (e.g., during fabric manufacturing) to produce a stretchable fire retardant fabric. Optionally, the fire retardant fabric formed from the fine denier OPF can be afforded cut resistance, by employing cut resistant fibers such as, but not limited to stainless steel wire filaments, p-ramids and liquid crystal polyethylenes. The cut resistant fibers can be introduced during the tow preparation, yarn formation and/or fabric manufacturing. Carbon fibers, ceramic fibers, glass fibers, metal fibers, polyesters and modacrylics, carbonaceous fibers (e.g. cotton, wool, polyester, polyolefin, nylon, rayon or novoloid phenolic), inorganic fibers (e.g. silica, silica alumina, potassium titanate, silicon carbide, silicon nitride, boron nitride, and boron), acrylic fibers, polysulfonamide fibers, tetrafluoroethylene fibers, polyamide fibers, vinyl fibers, protein fibers, oxide fibers derived from boron, thoria or zirconia, aramids and nylons could also be employed and introduced in addition to the fine denier OPF, during the tow formation, yarn formation and/or fabric manufacturing, to produce a hybrid tow, hybrid yarn and/or hybrid fire retardant fabric.

In addition, any one or more of the above described fibers, 40's cotton count polysulfonamide spun yarn and/or a polysulfonamide fiber roving to can be processed with, for example simultaneously with, a yarn formed from the fine denier OPF to produce a hybrid fire retardant fabric.

The tow of the fine denier OPF are formed into a fire retardant yarn in a suitable forming apparatus and process, for example the apparatus and process disclosed in commonly owned and copending U.S. patent application Ser. No. 11/600,681, filed Nov. 15, 2006, as described below. Use of the apparatus and process with the fine denier OPF have utility and generates the unexpected result of being able to use the fine denier OPF to form the yarn therefrom. Prior to the discovery of the present invention, such fine denier OPF were considered by those skilled in the relevant are to be too fine and therefore too difficult and expensive to handle and process. While, the tow of the fine denier OPF are described as being formed into a fire retardant yarn in the apparatus and process disclosed in commonly owned and copending U.S. patent application Ser. No. 11/600,681, the present invention is not limited in this regard, as other apparatuses and processes can be employed including but not limited to forming the tow of the fine denier OPF into a fire retardant fabric, without the fine denier OPF having been formed into a yarn, as described below.

Figure 2:
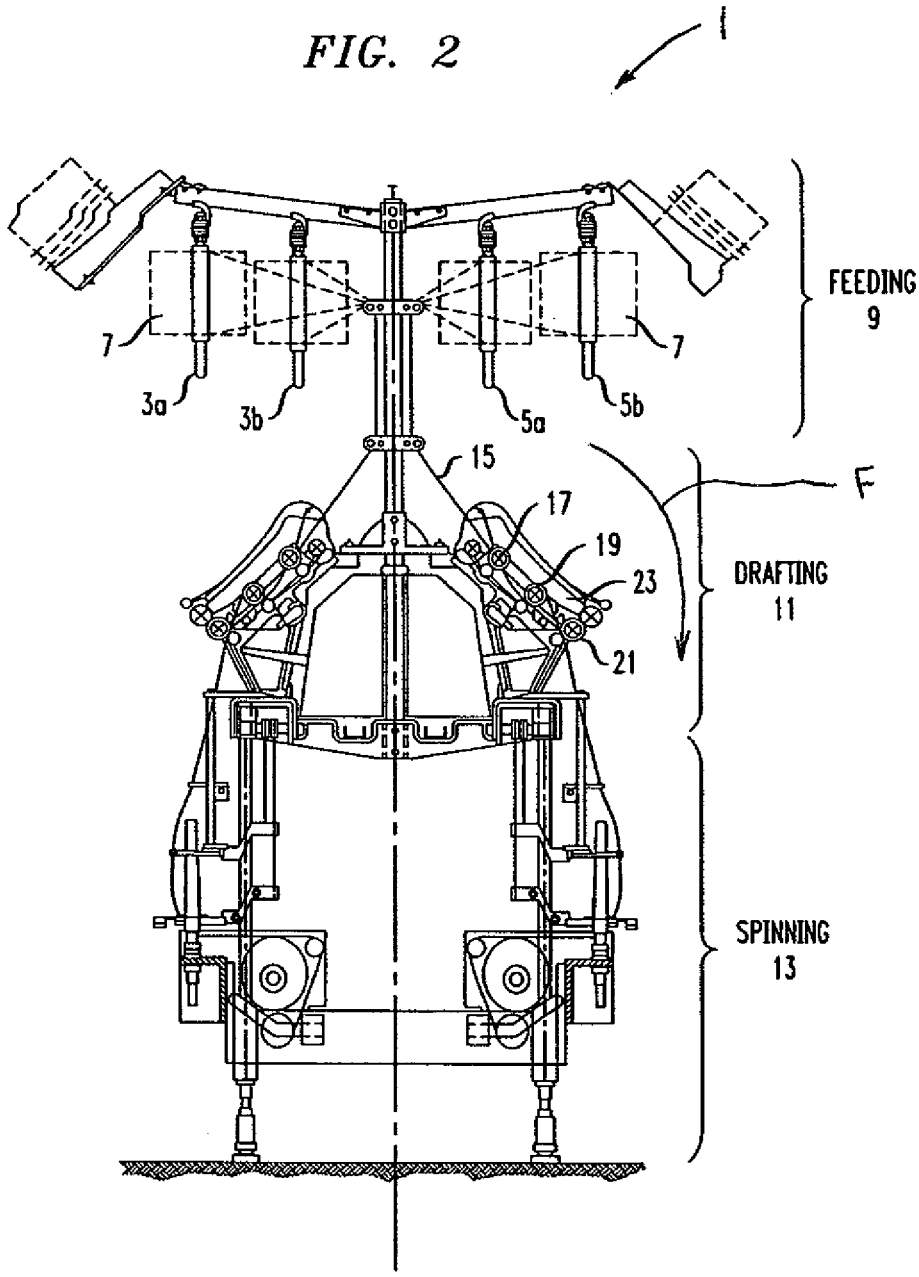
FIG. 2 is a schematic illustration of an apparatus for forming a yarn.

Referring to FIG. 2, an apparatus for forming the fine denier OPF into a yarn in a continuous operation is generally referred to by element number 1. The apparatus 1 includes a feeding component 9 operably coupled to a drafting component 11 positioned downstream thereof. The drafting component 11 is operably coupled to a spinning component 13 positioned downstream thereof. The illustrated apparatus 1 is configured to form one or more yarns in a continuous operation. In one embodiment, the continuous operation does not require transport, storage or accumulation of the fine denier OPF to a location away from the apparatus 1.

The feeding component 9 includes four rollers 3*a*, 3*b*, 5*a* and 5*b* removeably mounted thereto. A spool 7 is removably mounted on each of rollers 3*a*, 3*b*, 5*a* and 5*b*. Each of the spools 7 has a starting material positioned thereon, for example by a winding operation. The starting material is the fine denier OPF arranged in a tow 15 such that individual fibers of the finer denier OPF are longitudinally aligned with one another in a generally flat and untwisted form (e.g., less than 50 twists per meter). Although the starting material is described as being the fine denier OPF, the present invention is not limited in this regard as one or more other fibers including those described above can be employed as suitable starting materials either alone or in combination with the fine denier OPF.

Referring to FIG. 2, each of the rollers 3*a*, 3*b*, 5*a* and 5*b* include tension disks (not shown) that maintain tension on the tow 15 and enable the tow 15 to be delivered to the drafting component 11 in a flat and untwisted manner. In one exemplary embodiment, the tension disks enable the tow to be maintained in the generally flat and untwisted form for a length of up to about 30 meters between the rollers 3*a*, 3*b*, 5*a* or 5*b* and the drafting component 11.

The drafting component 11 includes a first roller pair 17, a second roller pair 19 and a third roller pair 21 rotatably mounted thereon. The second roller pair 19 is positioned downstream of the first roller pair 17, with respect to the flow of fine denier OPF through the drafting component 11 in the direction generally designated by the arrow F. The third roller pair 21 is positioned downstream of the second roller pair 19, with respect to the flow of fine denier OPF through the drafting component 11. The drafting component 17 also includes a pendulum carrier 23 for applying pressure to three pressurizing elements (not shown), each of which urge the rollers of the respective roller pairs 17, 19 and 21 toward each other.

Each of the rollers of the first roller pair 17 are conterminous and have a first rotational speed. Each of the rollers of the second roller pair 19 are conterminous and have a second rotational speed, greater than the first rotational speed. In addition, each of the rollers of the third roller pair 21 are conterminous and have a third rotational speed, greater than the second rotational speed. The rollers of the first roller pair 17 rotate in opposite directions; the rollers of the second roller pair 19 rotate in opposite directions; and the rollers of the third roller pair 21 rotate in opposite directions. For example, one of the rollers of the first roller pair 17 rotates in a clockwise direction with respect to a longitudinal axis of the roller and the other roller of the first roller pair rotates in a counterclockwise direction with respect to a longitudinal axis of the other roller. The opposing direction of rotation of the rollers of the first roller pair enables the fine denier OPF to be pulled therebetween and to be subsequently discharged therefrom. The first and second rotational speeds are selected to stretch and break substantially all of the fine denier OPF to produce a cohesive elongated network of the fine denier OPF. For example, first and second rotational speeds are selected to stretch and break substantially all of the fine denier OPF to a length within a range of about 2.5 cm to about 23 cm.

In one embodiment, the first roller pair 17 and the second roller pair 19 are spaced apart from one another by a distance of about 50 mm to about 240 mm. In one embodiment, the first roller pair 17 and the second roller pair 19 are spaced apart from one another by a distance of about 105 mm. In one embodiment, the second roller pair 19 and the third roller pair 21 are spaced apart by a distance of about 50 mm to about 200 mm. In one embodiment, the second roller pair 19 and the third roller pair 21 are spaced apart by a distance of about 135 mm. In one exemplary embodiment, the first roller pair 17 and third roller pair 21 are spaced apart from one another by a distance of about 150 mm to about 240 mm. In one exemplary embodiment, the first roller pair 17 and third roller pair 21 are spaced apart from one another by a distance of about 180 mm.

The spinning component 13 includes one or more bobbins (not shown) removably mounted thereon. The spinning component 13 is configured to receive the cohesive elongated network of fine denier OPF and to spin and twist the cohesive elongated network of fine denier OPF onto the bobbins to form the yarn. For example, the spinning component is configured to twist the yarn such that the yarn has a twist count of about 100 twists per meter to about 800 twists per meter.

The yarns formed from the fine denier OPF are subsequently formed into a fire retardant fabric by a suitable manufacturing process including but not limited to weaving, knitting, braiding and stitch-bonding. In one embodiment, the finer denier OPF tow is chopped into staple fiber and subsequently formed into the fire retardant fabric by nonwoven processes. For example, large tows (e.g., greater than 24,000 fibers) of the fine denier OPF can be chopped into staple and used to produce fabrics using nonwoven processes, including but not limited to needle punching, air-laid, felting, water jet entanglement, air jet entanglement and the like. Fabrics such as these find application in fire retardant and thermal insulating materials, for example clothing, boot and shoe liners, coat linings and fire protection blankets.

Each of the above described fire retardant fabrics has: 1) a vertical flammability char length pursuant to ASTM D6413 of about zero to about 2.0 inch or about zero to about 0.5 inch; 2) an afterflame time pursuant to ASTM D6413 of about zero to about 0.5 seconds or about zero to about 0.1 seconds; 3) an LOI value of about 40% to about 60%; and/or 4) a Thermal Protective Performance (TPP) value, pursuant to ASTM F1060, of about 12 to about 25 seconds for a single layer fire retardant fabric and about 20 to 50 seconds for two layers of the fire retardant fabric.

The present invention includes a method for manufacturing fire retardant fabrics. The method employs the apparatus 1 for converting a tow of fine denier OPF into a yarn in a continuous operation, as described above. The tow of the fine denier OPF is positioned on one or more of the spools 7 such that each of the individual fibers of the fine denier OPF are longitudinally aligned with each other in a generally flat and untwisted form. The tow is pulled from the spools by unwinding and applying tension, thereby maintaining the tow in the generally flat and untwisted form.

The tow is the fed from the feed component 9 to the drafting component 11 where the fine denier OPF are stretched and broken to form the cohesive elongated network of the fine denier OPF. The stretching and breaking of the fine denier OPF occurs by directing the tow through the first and second roller pairs 17, 19 while applying pressure to urge the respective roller of each of the first and second roller pairs towards one another, as described further below. In one embodiment, the fine denier OPF are stretched and broken into pieces, substantially all of which have a length within a range of about 2.5 to 23 cm. Each of the rollers of the first roller pair 17 have substantially conterminous opposed surfaces and spin at a first rotational speed. Each of the rollers of the second roller pair 19 are positioned downstream of the first roller pair 17, have substantially conterminous opposed surfaces and spin at a second speed. The second speed is greater than the first speed, thereby causing the stretching and breaking of the fine denier OPF.

The cohesive elongated network of the fine denier OPF are discharged from the drafting component 11 to the spinning component 13. The spinning component spins and twists the cohesive elongated network of fine denier OPF into the yarn having a twist count of about 100 twists per meter to about 800 twists per meter. Providing the fine denier OPF tow on the spools, pulling the tow from the spools, applying tension to the first, second and third roller pairs, stretching and breaking the fine denier OPF to form the cohesive elongated network of the fine denier OPF and the spinning and twisting thereof, all take place in a single pass through the apparatus 1. The yarn formed from the fine denier OPF is subsequently formed into a fire retardant fabric by a knitting, a weaving, a braiding and/or a stitch-bonding process.

The present invention also includes a method of making a fire retardant fabric from the fine denier OPF tow. One or more tows of oxidized polyacrylonitrile fibers having a fineness of about 0.5 to about 1.5 denier per fiber are provided and are subsequently chopped into staple. The staple is formed into a fire retardant fabric by a needle punching, an air-laid, a felting, a water jet entanglement and/or an air jet entanglement process.

The following examples have been found to be particularly useful embodiments of the present invention, but are not to be construed as limiting the scope of the present invention in any way.

EXAMPLE 1

A 6,000 fiber OPF tow in which each of the individual fibers had a fineness of about 1.1 denier per fiber, was fed to though the apparatus 1, described above, to produce 18's singles cotton count spun OPF yarn. The 18's singles cotton count spun OPF was then knitted into a Jersey fabric construction. The Jersey knit fabric of Example 1 was subject to flammability testing and registered a limited oxygen index value (LOI) of 41.5. Two layers of Jersey knit fabric of Example 1, after laundering, were subject to Thermal Protective Performance (TPP) testing pursuant to ASTM F1060 and registered and TTP of 29.2. A single layer of the Jersey knit fabric of Example 1 was subject to flame resistance testing pursuant to ASTM D6413 and registered a 0.2 inch vertical flammability char length and 0.2 seconds afterflame time.

EXAMPLE 2

A 6,000 fiber OPF tow in which each of the individual fibers had a fineness of about 1.1 denier per fiber, was fed to though the apparatus 1, described above, simultaneously with a 40's cotton count polysulfonamide spun yarn to produce 18's singles cotton count hybrid spun OPF yarn. The 18's singles cotton count hybrid spun OPF yarn was then knitted into a Jersey fabric construction. A single layer of the Jersey knit fabric of Example 2 was subject to flame resistance testing pursuant to ASTM D6413 and registered a 0.2 inch vertical flammability char length and 0.45 seconds afterflame time.

EXAMPLE 3

A 6,000 fiber OPF tow in which each of the fiber had a fineness of 1.1 denier per fiber was woven directly into an 8×8 (ends X picks per inch) fabric construction without having first being processed into a yarn. The resulting fabric was found useful as a fire retardant fabric.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for making a fire retardant fabric comprising:

providing at least one tow of oxidized polyacrylonitrile fibers having a fineness of about 0.5 to about 1.5 denier per fiber;

providing an apparatus for converting a tow of said oxidized polyacrylonitrile fibers into said yarn, said apparatus comprising a feed section including at least one spool removably mounted thereon, said feed section being operably coupled to a drafting section comprising a first roller pair and a second roller pair, said drafting section being operably coupled to a spinning section comprising at least one bobbin removably mounted thereon;

positioning said tow of oxidized polyacrylonitrile fibers on said at least one spool, said fibers being longitudinally aligned with one another in a generally flat and untwisted form;

pulling said tow from said spool by unwinding and applying tension thereby maintaining said tow in said generally flat and untwisted form and feeding said generally flat and untwisted tow to said drafting component;

stretching and breaking said fibers of said tow to form a cohesive elongated network of fibers, in said drafting component by directing said tow through said first and second roller pairs while applying pressure to said first and second roller pairs, said first roller pair having substantially conterminous opposed surfaces and spinning at a first speed and said second roller pair being downstream and having substantially conterminous opposed surfaces and spinning at a second, faster speed, said pressure urging said second roller pair toward each other and said first roller pair toward each other;

spinning and twisting said cohesive elongated network of fibers onto said bobbin thereby forming said yarn and wherein said spinning and twisting causes said yarn to have a twist count of about 100 twists per meter to about 800 twists per meter;

wherein said providing said tow, said pulling, said applying tension, said stretching and breaking and said spinning and twisting all take place in a single pass through said apparatus; and forming said yarn into a fire retardant fabric by at least one of a knitting, a weaving, a braiding and a stitch-bonding process.

2. A method for producing a fire retardant heat resistant yarn, comprising:

feeding, drafting and spinning a starling material in a single pass apparatus to produce the fire retardant heat resistant yarn;

selecting said starting material from a group of starting materials consisting of a fine denier of polyacrylonitrile fibers, a fine denier of oxidized polyacrylonitrile fibers or a fine denier of carbonized polyacrylonitrile fibers;

wherein the fine denier fibers are arranged in a tow;

wherein individual fibers within said tow are longitudinally aligned with one another in a substantially flat and untwisted form; and wherein the individual fibers within said tow have a fineness of bout 0.5denier per fiber to about 1.5 denier per fiber.

3. The method according to claim 2, wherein said tow is provided with a twist count of less than 50 twists per meter.

4. The method according to claim 3, wherein said tow has between about 3000 individual fibers to about 24,000 individual fibers.

5. The method according to claim 4, wherein the step of drafting includes the step of stretching and breaking the individual fibers so that each fiber has a resulting length of between about 2.5 cm to about 23.0 cm.

6. the method according to claim 5, wherein the step of spinning includes the step of twisting so that the resulting yam has a twist count of about 100 twist per meter to about 800 twists per meter.

7. The method according to claim 2 wherein the step of feeding includes feeding said tow in a continuous operation is a drafting component disposed in said single pass apparatus;

maintaining a tension on said tow to facilitate the tow being delivered to said drafting component in said substantially flat and untwisted form.

8. The method according to claim 7, wherein said tension is a sufficient tension to enable the tow to be maintained in said substantially flat and untwisted form during said feeding step as the tow travels to said drafting component.

9. The method according to claim 8, wherein said step of drafting includes:

providing a first pair of rollers and a second pair of rollers;

positioning said second pair of rollers downstream of said first pair of rollers pair relative to the flow of the tow through said single pass apparatus; and applying pressure to respective ones of said first pair of rollers, and said second pair of rollers to urge each respective pair of rollers towards each other to facilitate the flow of the tow through said single pass apparatus.

10. The method according to claim 9, wherein said first pair of rollers are conterminous and have a first rotational speed and wherein said second pair of rollers are conterminous and have a second rotational speed; and wherein said second rotational speed is greater than said first rotational speed to facilitate breaking and stretching all of the fine denier fibers passing therebetween to produce a cohesive elongated network of fibers having a length within a range of about 2.5 cm and about 23 cm.

11. The method according to claim 8, wherein said step of drafting includes:

providing a first pair of rollers, a second pair of rollers, and a third pair of rollers;

positioning said second pair of rollers downstream of said first pair of rollers pair relative to the flow of the tow through said single pass apparatus;

positioning said third pair of rollers downstream of said second pair of rollers relative to the flow of the tow through said single pass apparatus;

applying pressure to respective ones of said first pair of rollers, said second pair of rollers and said third pair of rollers to urge each respective pair of rollers towards each other to facilitate the flow of the tow through said single pass apparatus;

wherein said first pair of rollers are conterminous and have a first rotational speed;

wherein said second pair of rollers are conterminous and have a second rotational speed;

wherein said third pair of rollers are conterminous and have a third rotational speed;

selecting a spacing distance between said second pair of rollers and said third pair of rollers to facilitate breaking and stretching all of the fine denier fibers passing between said second pair of rollers and said third pair of rollers to produce a cohesive elongated network of fibers having a length within a range of about 2.5 cm and about 23 cm; and selecting said third rotational speed and said second rotational speed to provide a draft ratio for facilitating the production of a desired yarn count.

12. The method according to claim 11, wherein said first pair of rollers and said second pair of rollers are spaced apart from one another by a distance of between about 50 mm and about 240 mm.

13. The method according to claim 12, wherein said second pair of rollers and said third pair of rollers are spaced apart from one another by a distance of between about 50 mm and about 200 mm.

14. The method according to claim 13, wherein said first pair of rollers and said third pair of rollers are spaced apart from one another by a distance of between about 100 mm and about 440 mm.

15. The method according to claim 2, wherein said step of spinning includes the step of twisting said cohesive elongated network of fibers onto a bobbin to form the yarn; and wherein said step of twisting is sufficient to cause the yarn to have a twist count of about 100 twist per meter to about 800 twists per meter.

16. A method for producing a fire retardant heat resistance fabric, comprising:

producing a fire retardant heat resistant yarn according to claim 2, and incorporating the yarn into a fabric.

17. The method according to claim 16, wherein said fire retardant heat resistant fabric has a vertical flammability char length of about zero to about 2.0 inch;

an after flame time of about zero to about 0.5 seconds;

a limiting oxygen index of about 40% to about 60%; and a thermal protective performance value of about 12 to about 24 for a single layer of the fire retardant heat resistant fabric.

18. A method of producing a fire retardant heat resistant yarn, comprising:

providing a single pass apparatus having a feeding section, a drafting section and a spinning section;

feeding a starting material from said feeding section to said drafting section, wherein said starting material is selected from a group of starting materials consisting of oxidized polyacrylonitrile fibers or polyacrylonitrile fibers or carbonized polyacrylonitrile fibers;

wherein said starting material is arranged in a tow wherein individual fibers within said tow are longitudinally aligned with one another in a substantially flat and substantially untwisted form; and wherein the individual fibers within said tow have a fineness of about 0.5denier per fiber to about 1.5 denier per fiber;

drafting said starting material in one single pass between a pair of upstream rollers and a pair of downstream roller to convert said starting material into a fire retardant heat resistant cohesive elongated network of fibers;

wherein said pair of downstream rollers operate at a faster rotational speed than said upstream pair of roller so that the filaments are stretched and broken into said fire retardant heat resistant cohesive elongated network of fibers comprising a plurality of generally flat, wool-like fibers capable of being directly spun into yarn; and directly spinning said plurality of generally flat, wool-like fibers into yarn in one spinning step that further twists said cohesive elongated network of fibers.

* * * * *